US006962269B2

(12) United States Patent
Hutchinson

(10) Patent No.: US 6,962,269 B2
(45) Date of Patent: Nov. 8, 2005

(54) SERVICE STATION LEAK DETECTION AND RECOVERY SYSTEM

(75) Inventor: Ray J. Hutchinson, Houma, LA (US)

(73) Assignee: Gilbarco Inc., Greensboro, NC (US)

( * ) Notice: Subject to any disclaimer, the term of this patent is extended or adjusted under 35 U.S.C. 154(b) by 157 days.

(21) Appl. No.: 10/173,990

(22) Filed: Jun. 18, 2002

(65) Prior Publication Data

US 2003/0230592 A1 Dec. 18, 2003

(51) Int. Cl.[7] ..... B67D 1/16

(52) U.S. Cl. ..... 222/109; 137/312; 141/86; 73/40.5 R

(58) Field of Search ..... 222/108–110; 137/312, 565.17; 138/114; 340/605; 141/85–86, 37, 59; 73/37, 40, 40.5 R, 40.5

(56) References Cited

U.S. PATENT DOCUMENTS

| | | | | |
|---|---|---|---|---|
| 4,088,987 A | | 5/1978 | Resler et al. | 340/242 |
| 4,410,109 A | | 10/1983 | Murrell, Jr. et al. | 222/52 |
| 4,639,164 A | | 1/1987 | Pugnale et al. | 405/54 |
| 4,796,676 A | | 1/1989 | Hendershot et al. | 141/83 |
| 4,805,444 A | | 2/1989 | Webb | 73/40.5 R |
| 4,871,084 A | * | 10/1989 | Robbins | 137/363 |
| 4,932,257 A | * | 6/1990 | Webb | 73/40.5 R |
| 4,966,190 A | | 10/1990 | Geisinger | 137/613 |
| 4,971,477 A | | 11/1990 | Webb et al. | 405/154 |
| 4,977,528 A | | 12/1990 | Norris | 364/571.04 |
| 5,014,543 A | | 5/1991 | Franklin et al. | 73/40.5 R |
| 5,027,849 A | | 7/1991 | Diesener | 137/236.1 |
| 5,040,577 A | | 8/1991 | Pope | 141/59 |
| 5,042,290 A | | 8/1991 | Geisinger | 73/40.5 R |
| 5,092,158 A | | 3/1992 | Tuma et al. | 73/3 |
| 5,098,221 A | | 3/1992 | Osborne | 405/52 |
| 5,134,878 A | | 8/1992 | Sharp | 73/49.2 |
| 5,157,958 A | | 10/1992 | Geisinger | 73/3 |
| 5,184,504 A | | 2/1993 | Spring | 73/49.2 |
| 5,244,307 A | | 9/1993 | Wokas | 405/53 |
| 5,257,652 A | | 11/1993 | Lawrence | 141/86 |
| 5,263,794 A | | 11/1993 | Webb | 405/52 |
| 5,265,652 A | | 11/1993 | Brunella | 141/59 |
| 5,297,896 A | | 3/1994 | Webb | 405/52 |
| 5,301,721 A | | 4/1994 | Hartmann | 141/59 |
| 5,319,545 A | | 6/1994 | McGarvey et al. | 364/403 |
| 5,343,191 A | | 8/1994 | McAtamney | 340/605 |
| 5,383,769 A | | 1/1995 | Williams | 417/238 |
| 5,390,713 A | | 2/1995 | Fiech | 141/98 |
| 5,400,253 A | | 3/1995 | O'Connor | 364/442 |
| 5,400,646 A | | 3/1995 | Kraus et al. | 73/49.2 |
| 5,423,457 A | | 6/1995 | Nicholas et al. | 222/62 |
| 5,427,474 A | | 6/1995 | Silvers | 405/52 |
| 5,490,544 A | | 2/1996 | Broline | 141/1 |
| RE35,238 E | | 5/1996 | Pope | 141/59 |

(Continued)

OTHER PUBLICATIONS

"Red Jacket, Quantum, 4 inch Submersible Pumps, Installation, Operation, Service & Repair Parts", 1997, 36 pages.

"Double Containment Piping System Design", Zui, Christopher, Handbook of Double Containment Piping Systems, 1995, pp. 569–649.

*Primary Examiner*—Frederick C. Nicolas
(74) *Attorney, Agent, or Firm*—Withrow & Terranova, PLLC

(57) ABSTRACT

A fueling environment that distributes fuel from a fuel supply to fuel dispensers in a daisy chain arrangement with a double walled piping system. Fuel leaks that occur within the double walled piping system are returned to the underground storage tank by the outer wall of the double walled piping. This preserves the fuel for later use and helps reduce the risk of environmental contamination. Leak detectors may also be positioned in fuel dispensers detect leaks and provide alarms for the operator and help pinpoint leak detection that has occurred in the piping system proximate to a particular fuel dispenser or in between two consecutive fuel dispensers.

39 Claims, 7 Drawing Sheets

U.S. PATENT DOCUMENTS 5,529,098 A * 6/1996 Bravo ..... 141/88
5,553,971 A 9/1996 Osborne ..... 405/52
5,556,679 A 9/1996 Booles ..... 428/36.91
5,557,965 A 9/1996 Fiechtner ..... 73/49.2
5,567,083 A 10/1996 Osborne ..... 405/154
5,568,449 A 10/1996 Rountree et al. ..... 367/99
5,586,586 A 12/1996 Fiech ..... 141/98
5,617,757 A 4/1997 Horner ..... 73/290 V
5,689,061 A 11/1997 Seitter et al. ..... 73/40.5 R
5,734,851 A 3/1998 Leatherman et al. ..... 395/329
5,775,842 A * 7/1998 Osborne ..... 405/154.1
5,782,579 A * 7/1998 Dupouy et al. ..... 405/52
5,799,834 A 9/1998 Small et al. ..... 222/148
5,831,149 A 11/1998 Webb ..... 73/40.5 R
5,853,113 A 12/1998 Small et al. ..... 222/379
5,912,712 A 6/1999 Doherty ..... 348/471
5,921,441 A 7/1999 Small et al. ..... 222/148
5,950,872 A 9/1999 Webb ..... 222/131
5,955,657 A 9/1999 Bravo ..... 73/40.5 R
5,956,259 A 9/1999 Hartsell, Jr. et al. .... 364/528.37
5,975,110 A * 11/1999 Sharp ..... 137/234.6
6,006,773 A * 12/1999 Bravo ..... 137/15.08
6,032,699 A 3/2000 Cochran et al. ..... 138/104
6,040,577 A 3/2000 Mauduit ..... 250/338.1
6,052,629 A 4/2000 Leatherman et al. ..... 700/241
6,082,392 A * 7/2000 Watkins, Jr. ..... 137/312
6,126,409 A 10/2000 Young ..... 417/297
6,129,529 A 10/2000 Young et al. ..... 417/423.3
6,158,460 A 12/2000 Clark et al. ..... 137/561 A
6,170,539 B1 1/2001 Pope et al. ..... 141/59
6,182,710 B1 2/2001 Webb ..... 141/1
6,223,765 B1 5/2001 Small et al. ..... 137/312
6,230,735 B1 * 5/2001 Bravo ..... 137/312
6,270,285 B1 8/2001 Wokas ..... 405/52
6,446,671 B2 * 9/2002 Armenia et al. ..... 138/109
6,489,894 B2 12/2002 Berg ..... 340/605
2002/0079016 A1 6/2002 Webb ..... 141/2
2003/0047211 A1 3/2003 Bravo et al. ..... 137/312
2003/0047212 A1 3/2003 Bravo et al. ..... 137/312
2003/0230593 A1 12/2003 Hutchinson ..... 222/1
2004/0035464 A1 2/2004 Folkers ..... 137/312
2004/0079799 A1 4/2004 Symonds et al. ..... 235/381
2004/0149017 A1 8/2004 Hutchinson et al. ..... 73/40.5 R
2004/0182136 A1 9/2004 Halla et al. ..... 73/49.2

* cited by examiner

SERVICE STATION LEAK DETECTION AND RECOVERY SYSTEM

FIELD OF THE INVENTION

The present invention relates to a fuel recovery system for recovery leaks that occur in fuel supply piping in a retail fueling environment.

BACKGROUND OF THE INVENTION

Managing fuel leaks in fueling environments has become more and more important in recent years as both state and federal agencies impose strict regulations requiring fueling systems to be monitored for leaks. Initially, the regulations required double walled tanks for storing fuel accompanied by leak detection for the tanks. Subsequently, the regulatory agencies have become concerned with the piping between the underground storage tank and the fuel dispensers and are requiring double walled piping throughout the fueling environment as well.

Typically, the double walled piping that extends between fuel handling elements within the fueling environment terminates at each end with a sump that is open to the atmosphere. In the event of a leak, the outer pipe fills and spills into the sump. The sump likewise catches other debris, such as water and contaminants that contaminate the fuel caught by the sump, thereby making this contaminated fuel unusable. Thus, the sump is isolated from the underground storage tank, and fuel captured by the sump is effectively lost.

Coupled with the regulatory changes in the requirements for the fluid containment vessels are requirements for leak monitoring such that the chances of fuel escaping to the environment are minimized. Typical leak detection devices are positioned in the sumps. These leak detection devices may be probes or the like and may be connected to a control system for the fueling environment such that the fuel dispensing is shut down when a leak is detected.

Until now, fueling environments have been equipped with elements from a myriad of suppliers. Fuel dispensers might be supplied by one company, the underground storage tanks by a second company, the fuel supply piping by a third company, and the tank monitoring equipment by yet a fourth company. This makes the job of the designer and installer of the fueling environment harder as compatibility issues and the like come into play. Further, it is difficult for one company to require a specific leak detection program with its products. Interoperability of components in a fueling environment may provide economic synergies to the company able to effectuate such, and provide better, more integrated leak detection opportunities.

Any fuel piping system that is installed for use in a fueling environment should advantageously reduce the risk of environmental contamination when a leak occurs and attempt to recapture fuel that leaks for reuse and to reduce excavation costs, further reducing the likelihood of environmental contamination. Still further, such a system should include redundancy features and help reduce the costs of clean up.

SUMMARY OF THE INVENTION

The present invention capitalizes on the synergies created between the tank monitoring equipment, the submersible turbine pump, and the fuel dispenser in a fueling environment. A fluid connection that carries a fuel supply for eventual delivery to a vehicle is made between the underground storage tank and the fuel dispensers via double walled piping. Rather than use the conventional sumps and low point drains, the present invention drains any fuel that has leaked from the main conduit of the double walled piping back to the underground storage tank. This addresses the need to recapture the fuel for reuse and to reduce fuel that is stored in sumps which must later be retrieved and excavated by costly service personnel.

The fluid in the outer conduit may drain to the underground storage tank by gravity coupled with the appropriately sloping piping arrangements, or a vacuum may be applied to the outer conduit from the vacuum in the underground storage tank. The vacuum will drain the outer conduit. Further, the return path may be fluidly isolated from the sumps, thus protecting the fuel from contamination.

In an exemplary embodiment, the fuel dispensers are connected to one another via a daisy chain fuel piping arrangement rather than by a known main and branch conduit arrangement. Fuel supplied to a first fuel dispenser by the submersible turbine pump and conduit is carried forward to other fuel dispensers coupled to the first fuel dispenser via the daisy chain fuel piping arrangement. The daisy chain is achieved by a T-intersection contained within a manifold in each fuel dispenser. Fuel leaking in the double walled piping is returned through the piping network through each downstream fuel dispenser before being returned to the underground storage tank.

The daisy chain arrangement allows for leak detection probes to be placed within each fuel dispenser so that leaks between the fuel dispensers may be detected. The multiplicity of probes causes leak detection redundancy and helps pinpoint where the leak is occurring. Further, the multiple probes help detect fuel leaks in the outer conduit of the double walled piping. This is accomplished by verifying that fuel dispensers downstream of a detected leak also detect a leak. If they do not, a sensor has failed or the outer conduit has failed. A failure in the outer piping is cause for serious concern as fuel may be escaping to the environment and a corresponding alarm may be generated.

Another possibility with the present invention is to isolate sumps, if still present within the fuel dispenser, from this return path of captured leaking fuel such that contaminants are precluded from entering the leaked fuel before being returned to the underground storage tank. In this manner, fuel may potentially be reused since it is not contaminated by other contaminants, such as water, and reclamation efforts are easier. Since the fuel is returned to the underground storage tank, there is less danger that a sump overflows and allows the fuel to escape into the environment.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
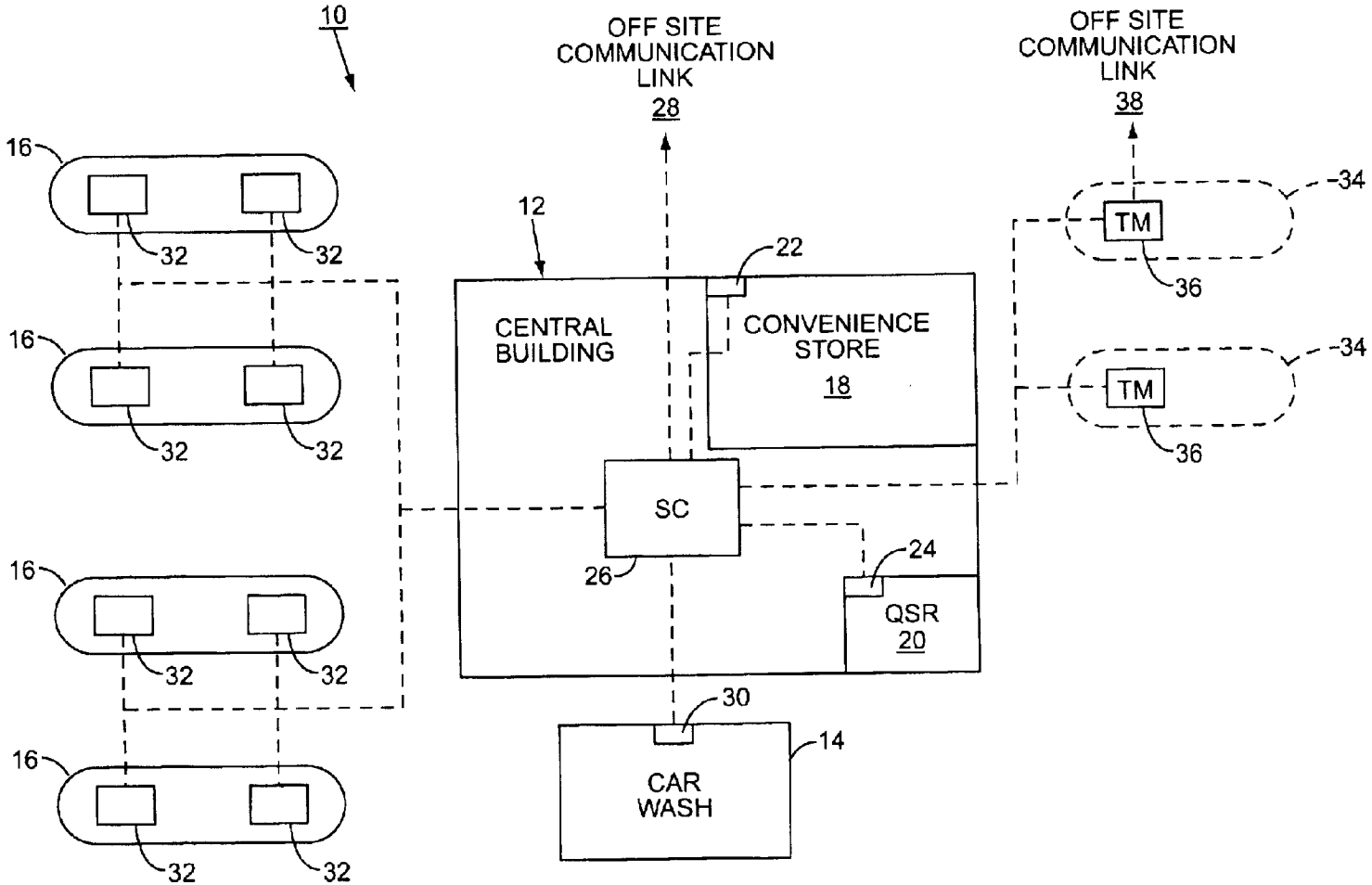
FIG. 1 PRIOR ART
FIG. 1 illustrates a conventional communication system within a fueling environment in the prior art.
Figure 2:
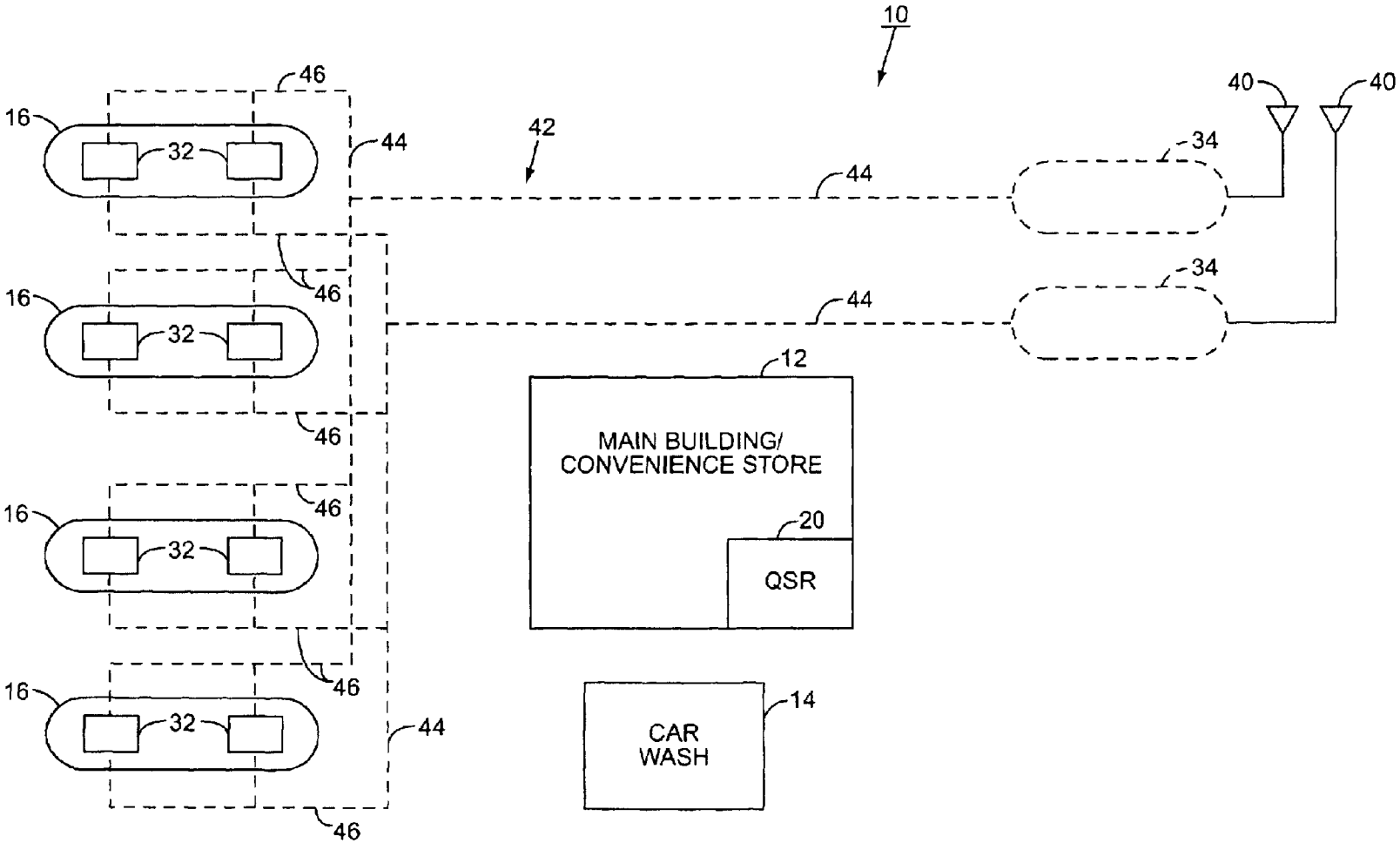
FIG. 2 PRIOR ART
FIG. 2 illustrates a conventional fueling path layout in a fueling environment in the prior art.

Fueling environments come in many different designs. Before describing the particular aspects of the present invention (which begins at the description of FIG. 3), a brief description of a fueling environment follows. A conventional exemplary fueling environment 10 is illustrated in FIGS. 1 and 2. Such a fueling environment 10 may comprise a central building 12, a car wash 14, and a plurality of fueling islands 16.

The central building 12 need not be centrally located within the fueling environment 10, but rather is the focus of the fueling environment 10, and may house a convenience store 18 and/or a quick serve restaurant 20 therein. Both the convenience store 18 and the quick serve restaurant 20 may include a point of sale 22, 24, respectively. The central building 12 may further house a site controller (SC) 26, which in an exemplary embodiment may be the G-SITE® sold by Gilbarco Inc. of Greensboro, N.C. The site controller 26 may control the authorization of fueling transactions and other conventional activities as is well understood. The site controller 26 may be incorporated into a point of sale, such as point of sale 22 if needed or desired. Further, the site controller 26 may have an off-site communication link 28 allowing communication with a remote location for credit/debit card authorization, content provision, reporting purposes or the like, as needed or desired. The off-site communication link 28 may be routed through the Public Switched Telephone Network (PSTN), the Internet, both, or the like, as needed or desired.

The car wash 14 may have a point of sale 30 associated therewith that communicates with the site controller 26 for inventory and/or sales purposes. The car wash 14 alternatively may be a stand alone unit. Note that the car wash 14, the convenience store 18, and the quick serve restaurant 18 are all optional and need not be present in a given fueling environment.

The fueling islands 16 may have one or more fuel dispensers 32 positioned thereon. The fuel dispensers 32 may be, for example, the ECLIPSE® or ENCORE® sold by Gilbarco Inc. of Greensboro, N.C. The fuel dispensers 32 are in electronic communication with the site controller 26 through a LAN or the like.

The fueling environment 10 also has one or more underground storage tanks 34 adapted to hold fuel therein. As such the underground storage tank 34 may be a double walled tank. Further, each underground storage tank 34 may include a tank monitor (TM) 36 associated therewith. The tank monitors 36 may communicate with the fuel dispensers 32 (either through the site controller 26 or directly, as needed or desired) to determine amounts of fuel dispensed and compare fuel dispensed to current levels of fuel within the underground storage tanks 34 to determine if the underground storage tanks 34 are leaking.

The tank monitor 36 may communicate with the site controller 26 and further may have an off-site communication link 38 for leak detection reporting, inventory reporting, or the like. Much like the off-site communication link 28, off-site communication link 38 may be through the PSTN, the Internet, both, or the like. If the off-site communication link 28 is present, the off-site communication link 38 need not be present and vice versa, although both links may be present if needed or desired. As used herein, the tank monitor 36 and the site controller 26 are site communicators to the extent that they allow off site communication and report site data to a remote location.

For further information on how elements of a fueling environment 10 may interact, reference is made to U.S. Pat. No. 5,956,259, which is hereby incorporated by reference in its entirety. Information about fuel dispensers may be found in commonly owned U.S Pat. Nos. 5,734,851 and 6,052,629, which are hereby incorporated by reference in their entirety. Information about car washes may be found in commonly owned U.S. patent application Ser. No. 10/430,689, filed 06 May 2002, entitled SERVICE STATION CAR WASH, which is hereby incorporated by reference in its entirety. An exemplary tank monitor 36 is the TLS-350R manufactured and sold by Veeder-Root. For more information about tank monitors 36 and their operation, reference is made to U.S. Pat. Nos. 5,423,457; 5,400,253; 5,319,545; and 4,977,528, which are hereby incorporated by reference in their entireties.

In addition to the various conventional communication links between the elements of the fueling environment 10, there are conventional fluid connections to distribute fuel about the fueling environment as illustrated in FIG. 2. Underground storage tanks 34 may each be associated with a vent 40 that allows over-pressurized tanks to relieve pressure thereby. A pressure valve (not shown) is placed on the outlet side of each vent 40 to open to atmosphere when the underground storage tank 34 reaches a predetermined pressure threshold. Additionally, under-pressurized tanks may draw air in through the vents 40. In an exemplary embodiment, two underground storage tanks 34 exist—one a low octane tank (87) and one a high octane tank (93). Blending may be performed within the fuel dispensers 32 as is well understood to achieve an intermediate grade of fuel. Alternatively, additional underground storage tanks 34 may be provided for diesel and/or an intermediate grade of fuel (not shown).

Pipes 42 connect the underground storage tanks 34 to the fuel dispensers 32. Pipes 42 may be arranged in a main conduit 44 and branch conduit 46 configuration, where the main conduit 44 carries the fuel to the branch conduits 46, and the branch conduits 46 connect to the fuel dispensers 32. Typically, pipes 42 are double walled pipes comprising an inner conduit and an outer conduit. Fuel flows in the inner conduit to the fuel dispensers, and the outer conduit insulates the environment from leaks in the inner conduit. For a better explanation of such pipes and concerns about how they are connected, reference is made to Chapter B13 of PIPING HANDBOOK, $7^{th}$ edition, copyright 2000, published by McGraw-Hill, which is hereby incorporated by reference.

In a typical service station installation, leak detection may be performed by a variety of techniques, including probes and leak detection cables. More information about such devices can be found in the previously incorporated PIPING HANDBOOK. Conventional installations do not return to the underground storage tank 34 fuel that leaks from the inner conduit to the outer conduit, but rather allow the fuel to be captured in low point sumps, trenches, or the like, where the fuel mixes with contaminants such as dirt, water and the like, thereby ruining the fuel for future use without processing.

While not shown, vapor recovery systems may also be integrated into the fueling environment 10 with vapor recovered from fueling operations being returned to the underground storage tanks 34 via separate vapor recovery lines (not shown). For more information on vapor recovery systems, the interested reader is directed to U.S. Pat. Nos. 5,040,577; 6,170,539; and Re. 35,238, and U.S. patent application Ser. No. 09/783,178 filed Feb. 14, 2001, all of which are hereby incorporated by reference in their entireties.

Figure 3:
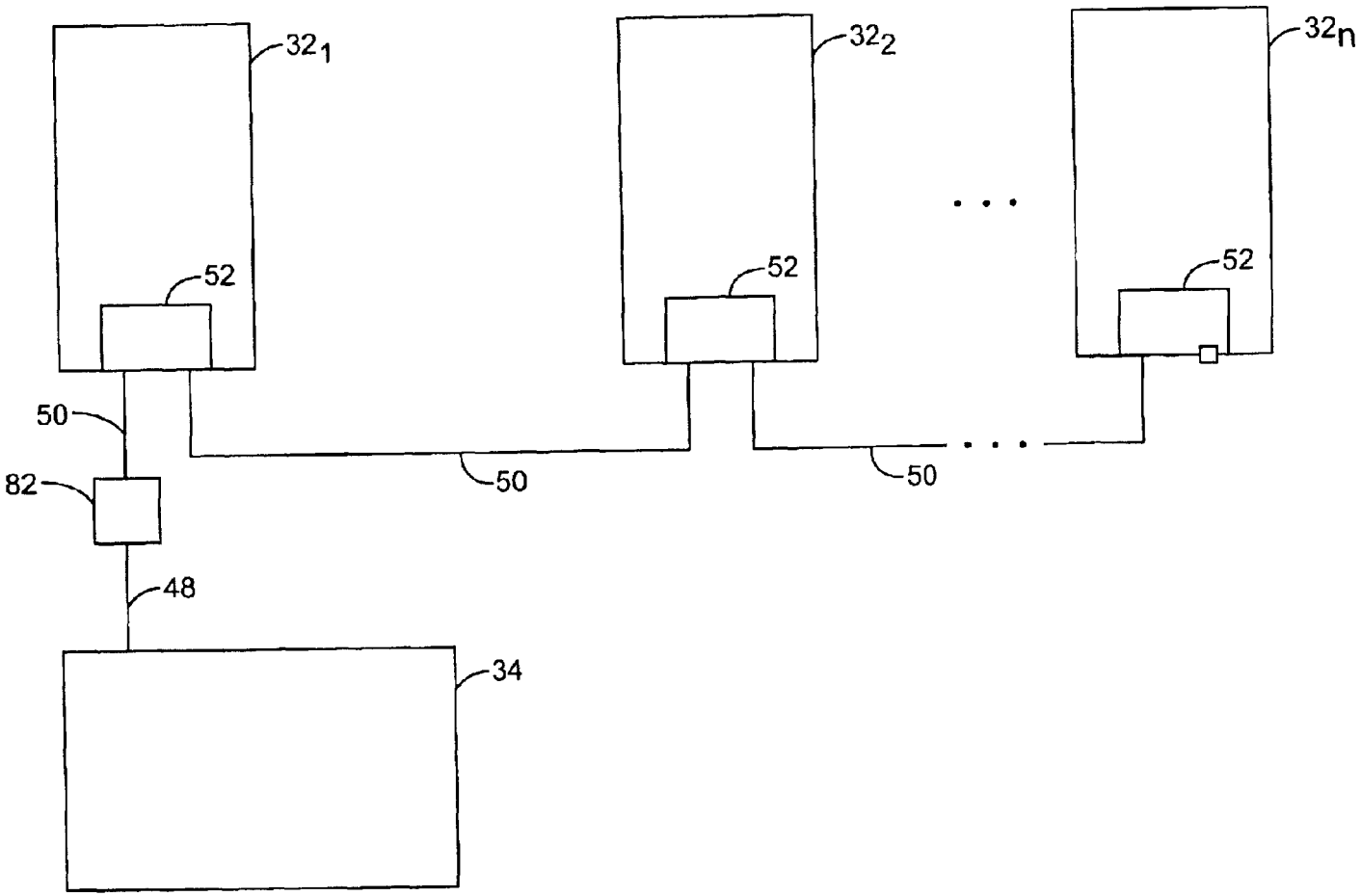
FIG. 3 illustrates, according to an exemplary embodiment of the present invention, a daisy chain configuration for a fueling path in a fueling environment.

Now turning to the present invention, the main and branch fuel supply conduit arrangement of FIG. 2 is replaced by a daisy chain fuel supply arrangement as illustrated in FIG. 3. The underground storage tank 34 provides a fuel delivery path to a first fuel dispenser 32, via a double walled pipe 48. The first fuel dispenser $_{32}$ is configured to allow the fuel delivery path to continue onto a second fuel dispenser 322 via a daisy chaining double walled pipe 50. This process repeats until an nth fuel dispenser $\mathbf{32}_n$ is reached. Each fuel dispenser 32 has a manifold 52 with an inlet aperture and an outlet aperture as will be better explained below. In the nth fuel dispenser $\mathbf{32}_n$, the outlet aperture is terminated conventionally as described in the previously incorporated PIPING HANDBOOK.

Figure 4:
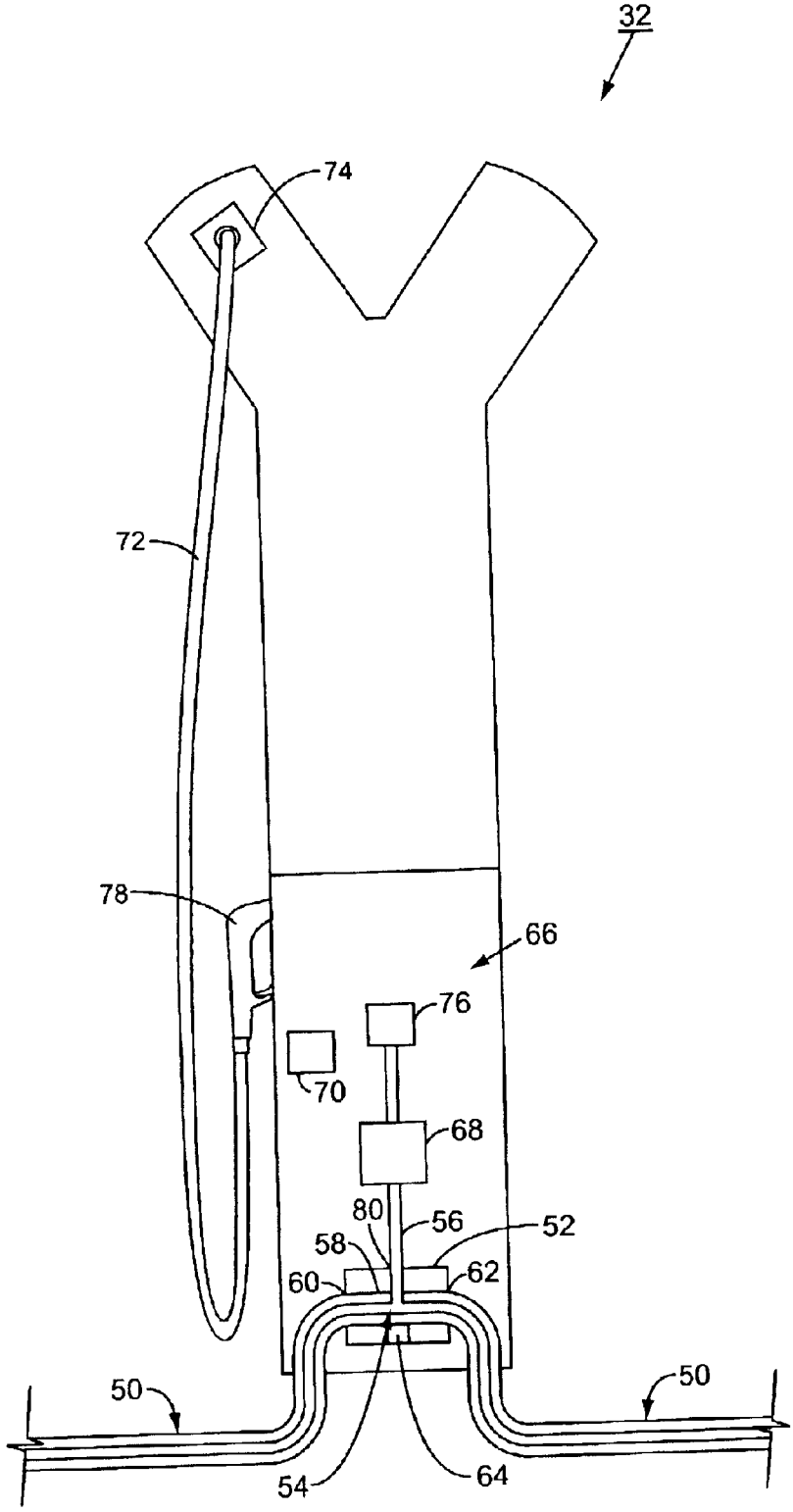
FIG. 4 illustrates, according to an exemplary embodiment of the present invention, a fuel dispenser.

As better illustrated in FIG. 4, each fuel dispenser 32 comprises a manifold 52 with a T-intersection 54 housed therein. The T-intersection 54 allows the fuel line conduit 56 to be stubbed out of the daisy chaining double walled pipe 50 and particularly to extend through the outer wall 58 of the daisy chaining double walled pipe 50. This T-intersection 54 may be a conventional T-intersection such as is found in the previously incorporated PIPING HANDBOOK. The manifold 52 comprises the aforementioned inlet aperture 60 and outlet aperture 62. While shown on the sides of the manifold 52's housing, they could equivalently be on the bottom side of the manifold 52, if desired. Please note that the present invention is not limited to a manifold 52 with a T-joint, and that any other suitable configuration may be used that allows fuel to be supplied to a fuel dispenser 32 and allows to continue on as well to the next fuel dispenser 32 until the last fuel dispenser 32 is reached.

A leak detection probe 64 may also be positioned within the manifold 52. This leak detection probe 64 may be any appropriate liquid detection sensor as needed or desired. The fuel dispenser 32 has conventional fuel handling components 66 therein, such as a fuel pump 68, a vapor recovery system 70, a fueling hose 72, a blender 74, a flow meter 76, and a fueling nozzle 78. Other fuel handling components 66 may also be present as is well understood in the art.

With this arrangement, the fuel may flow into the fuel dispenser 32 in the fuel line conduit 56, passing through the inlet aperture 60 of the manifold 52. A check valve 80 may be used if needed or desired as is well understood to prevent fuel from flowing backwards. The fuel handling components 66 draw fuel through the check valve 80 and into the handling area of the fuel dispenser 32. Fuel that is not needed for that fuel dispenser 32 is passed through the manifold 52 upstream to the other fuel dispensers 32 within the daisy chain. A sump (not shown) may still be associated with the fuel dispenser 32, but it is fluidly isolated from the daisy chaining double walled pipe 50.

Figure 5:
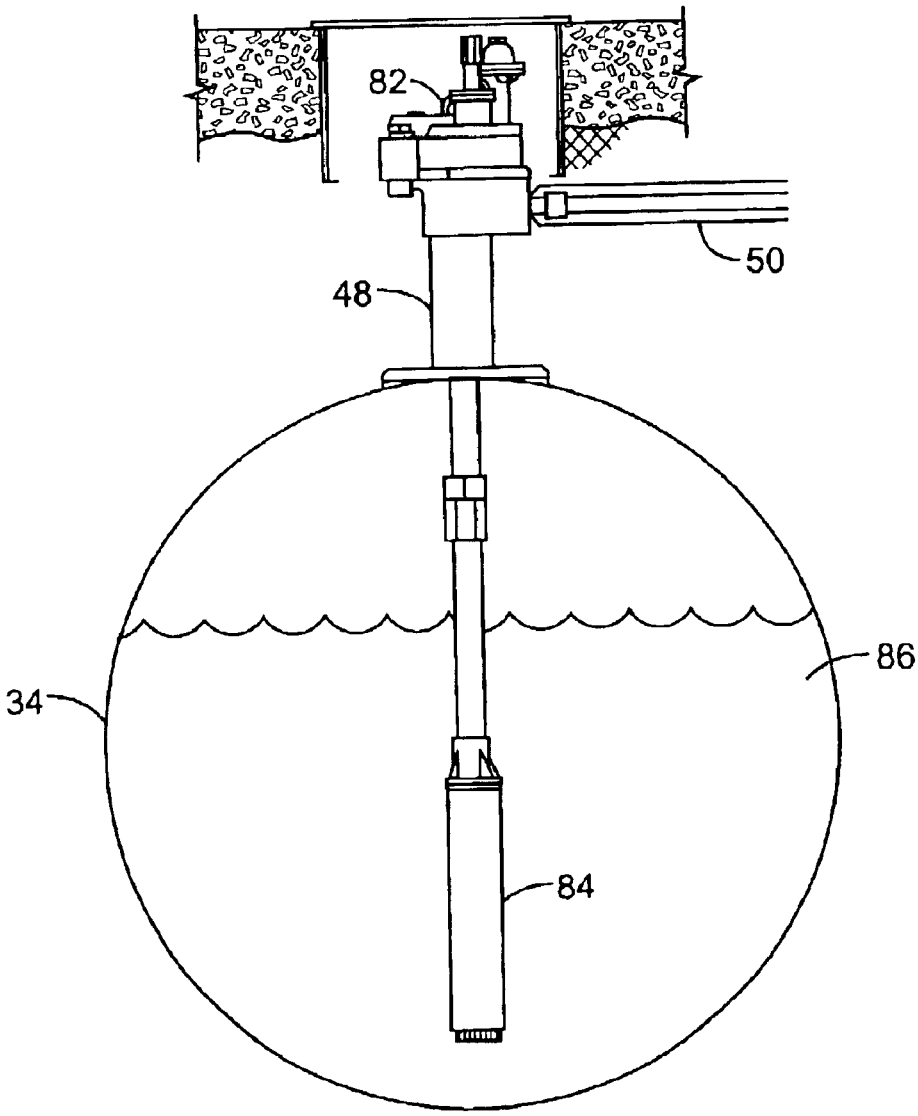
FIG. 5 illustrates a first embodiment of a fuel return to underground storage tank arrangement.

A first embodiment of the connection of the daisy chaining double walled pipe 50 to the underground storage tank 34 is illustrated in FIG. 5. The daisy chaining double walled pipe 50 connects to a casing construction 82, which in turn connects to the double walled pipe 48. A submersible turbine pump 84 is positioned within the underground storage tank 34, preferably below the level of fuel 86 within the underground storage tank 34. For a more complete exploration of the casing construction 82 and the submersible turbine pump 84, reference is made to U.S. Pat. No. 6,223,765 assigned to Marley Pump Company, which is incorporated herein by reference in its entirety, and the product exemplifying the teachings of the patent explained in *Quantum Submersible Pump Manual: Installation and Operation*, also produced by the Marley Pump Company, also incorporated by reference in its entirety. In this embodiment, fuel captured by the outer wall 58 is returned to the casing construction 82 such as through a vacuum or by gravity feeds. A valve (not shown) may allow the fuel to pass into the casing construction 82 and thereby be connected to the double walled pipe 48 for return to the underground storage tank 34. The structure of the casing construction in the '765 patent is well suited for this purpose having multiple paths by which fuel may be returned to the outer wall of the double walled pipe that connects the casing construction 82 to the submersible turbine pump 84.

Figure 6:
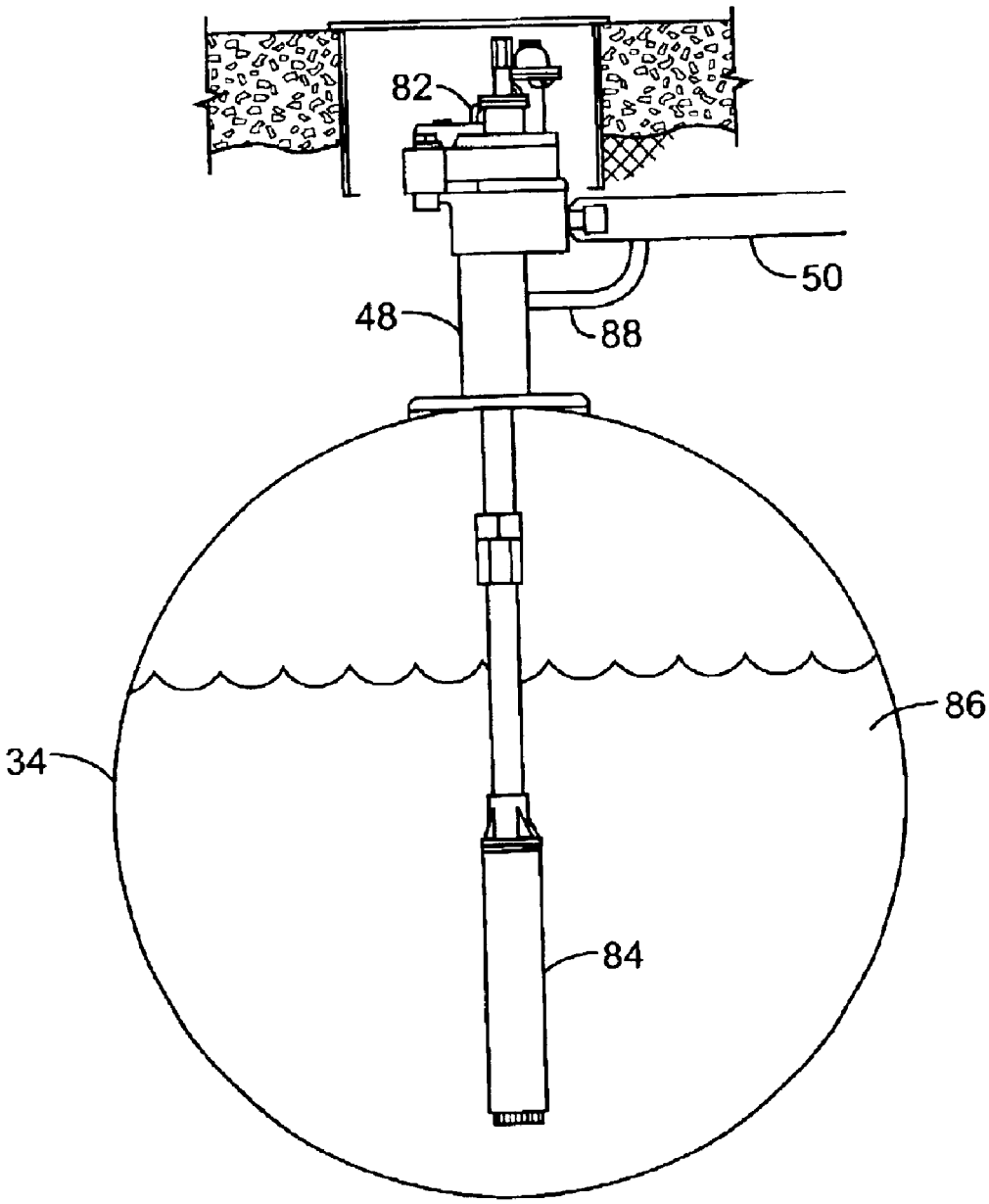
FIG. 6 illustrates a second embodiment of a fuel return to underground storage tank arrangement.

A second embodiment of the connection of the daisy chaining double walled pipe 50 to the underground storage tank 34 is illustrated in FIG. 6. The casing construction 82 is substantially identical to the previously incorporated U.S. Pat. No. 6,223,765. The daisy chaining double walled pipe 50 however comprises a fluid connection 88 to the double walled pipe 48. This allows the fuel in the outer wall 58 to drain directly to the underground storage tank 34, instead of having to provide a return path through the casing construction 82. Further, the continuous fluid connection from the underground storage tank 34 to the outer wall 58 causes any vacuum present in the underground storage tank 34 to also be existent in the outer wall 58 of the daisy chaining double walled pipe 50. This vacuum may help drain the fuel back to the underground storage tank 34. In an exemplary embodiment, the fluid connection 88 may also be double walled so as to comply with any appropriate regulations.

Figure 7:
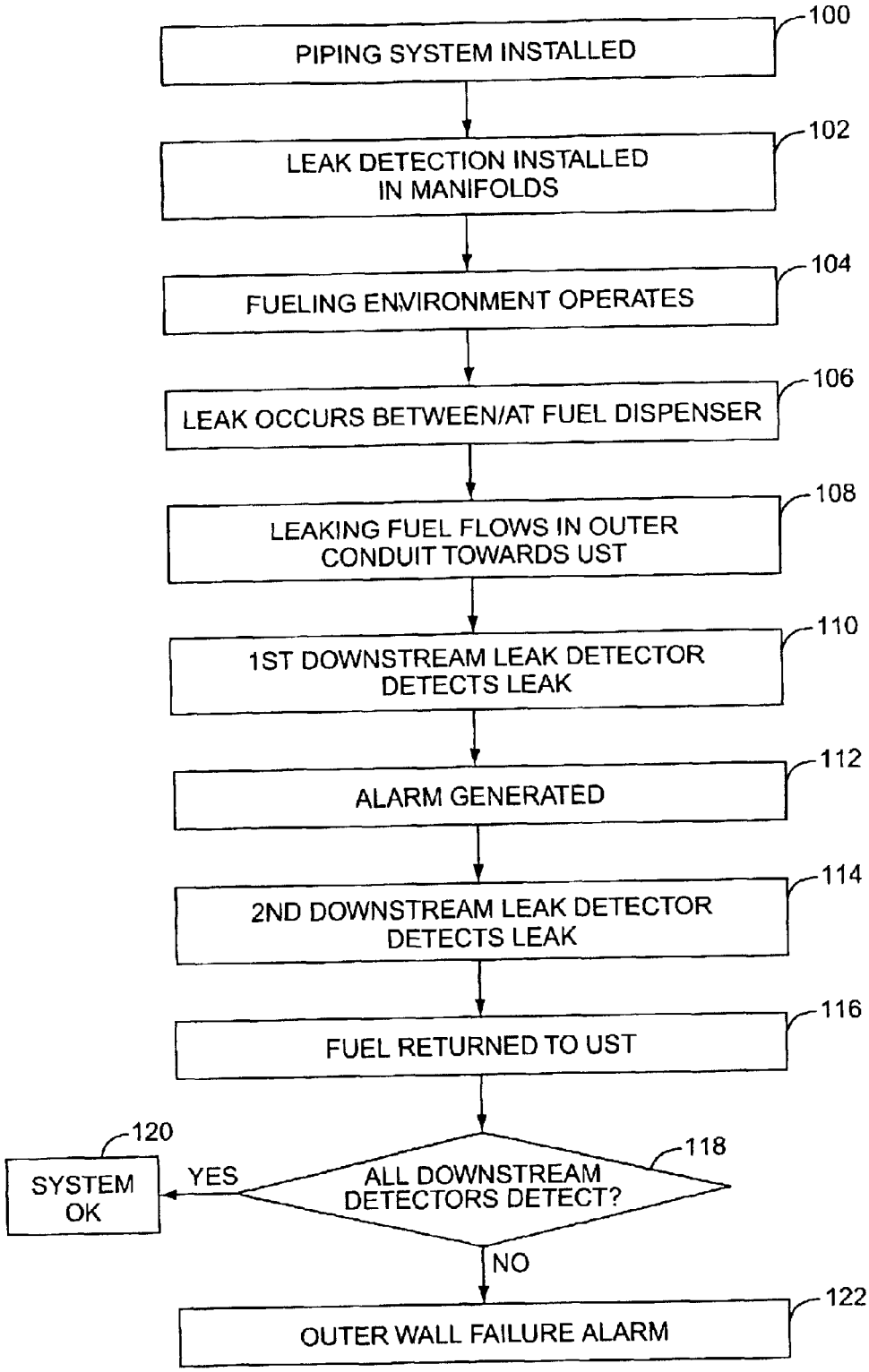
FIG. 7 illustrates a flow chart showing the leak detection functionality of the present invention.

FIG. 7 illustrates the methodology of the present invention. During new construction of the fueling environment 10, or perhaps when adding the present invention to an existing fueling environment 10, the daisy chained piping system according to the present invention is installed (block 100). The pipe connection between the first fuel dispenser $\mathbf{32}_1$ and the underground storage tank 34 may, in an exemplary embodiment, be sloped such that gravity assists the drainage from the fuel dispenser 32 to the underground storage tank 34. The leak detection system, and particularly, the leak detection probes 64, are installed in the manifolds 52 of the fuel dispensers 32 (block 102). Note that the leak detection probes 64 may be installed during construction of the fuel dispensers 32 or retrofit as needed. In any event, the leak detection probes 64 may communicate with the site communicators such as the site controller 26 or the tank monitor 36 as needed or desired. This communication may be for alarm purposes, calibration purposes, testing purposes or the like as needed or desired. Additionally, this communication may pass through the site communicator to a remote location if needed. Further, note that additional leak detectors (not shown) may be installed for redundancies and/or positioned in the sumps of the fuel dispensers 32. Still further, leak detection programs may be existent to determine if the underground storage tank 34 is leaking. These additional leak detection devices may likewise communicate with the site communicator as needed or desired.

The fueling environment 10 operates as is conventional, with fuel being dispensed to vehicles, vapor recovered, consumers interacting with the points of sale, and the operator generating revenue (block 104). At some point a leak occurs between two fuel dispensers $\mathbf{32}_x$ and $\mathbf{32}_{x+1}$. Alternatively, the leak may occur at a fuel dispenser $\mathbf{32}_{x+1}$ (block 106). The leaking fuel flows towards the underground storage tank 34 (block 108), as a function of the vacuum existent in the outer wall 58, via gravity or the like. The leak is detected at the first downstream leak detection probe 64 (block 110). Thus, in the two examples, the leak would be detected by the leak detection probe 64 positioned within the fuel dispenser $\mathbf{32}_x$. This helps in pinpointing the leak. An alarm may be generated (block 112). This alarm may be reported to the site controller 26, the tank monitor 36 or other location as needed or desired.

A second leak detection probe 64, positioned downstream of the first leak detection probe 64 in the fuel dispenser $\mathbf{32}_{x-1}$, will then detect the leaking fuel as it flows past the second leak detection probe 64 (block 114). This continues, with the leak detection probe 64 in each fuel dispenser 32 downstream of the leak detecting the leak until fuel dispenser $\mathbf{32}_1$ detects the leak. The fuel is then returned to the underground storage tank 34 (block 116).

If all downstream leak detection probes 64 detect the leak at query block 118, that is indicative that the system works (block 120). If a downstream leak detection probe 64 fails to detect the leak during the query of block 118, then there is potentially a failure in the outer wall 58 and an alarm may be generated (block 122). Further, if the leak detection probes 64 associated with fuel dispensers $\mathbf{32}_{x+1}$, and $\mathbf{32}_{x-1}$ both detect the leak, but the leak detection probe 64 associated with the fuel dispenser $\mathbf{32}_x$ does not detect a leak, that is indicative of a sensor failure and a second type of alarm may be generated.

Additionally, once a leak is detected and the alarm is generated, the fueling environment 10 may shut down so that clean up and repair can begin. However, if the double walled piping system works the way it should, the only repair will be to the leaking section of inner pipe within the daisy chaining double walled pipe 50 or the leaking fuel dispenser 32. Any fuel may caught by the outer wall 58 is returned for reuse, thus saving on clean up.

Those skilled in the art will recognize improvements and modifications to the preferred embodiments of the present invention. All such improvements and modifications are considered within the scope of the concepts disclosed herein and the claims that follow.

What is claimed is:

1. A fueling environment, comprising:

a plurality of fuel dispensers;

a double walled piping system adapted to connect fluidly said plurality of fuel dispensers in a daisy chained arrangement such that fuel is delivered to each of the fuel dispensers from an underground storage tank by an inner conduit and leaks within the double walled piping system are returned to the underground storage tank by an outer conduit; and at least one leak monitor associated with at least one of said plurality of fuel dispensers, said at least one leak monitor positioned in said outer conduit;

said leaks within the double walled piping system are returned to the underground storage tank with vacuum assistance, wherein at least one of the plurality of fuel dispensers comprises:

fuel handling components;

a housing delimiting:

a fuel inlet aperture receiving an incoming portion of the double walled piping system; and a fuel outlet aperture adapted to allow an outgoing portion of the double walled piping system so that fuel is passed to a downstream fuel dispenser within the plurality of fuel dispensers; and a manifold, wherein said double walled piping system includes a t-intersection positioned within said manifold such that fuel is distributed to said fuel handling components, wherein said outer conduit is positioned at least partially within said manifold and extends from said fuel inlet aperture to said fuel outlet aperture without being terminated inside the manifold or at the fuel inlet aperture or at the fuel outlet aperture and substantially prevents fluid passage from said outer conduit to said manifold.

2. The fueling environment of claim 1 wherein said leaks within the double walled piping system are returned to the underground storage tank via gravity.

3. The fueling environment of claim 1 further comprising:

the underground storage tank, wherein the underground storage tank is adapted to store fuel for the fueling environment.

4. The fueling environment of claim 3 wherein said fuel handling components comprise elements selected from the group consisting of: a fuel pump, a vapor recovery system, a fueling hose, a blender, a flow meter, and a fueling nozzle.

5. The fueling environment of claim 1 wherein said at least one leak monitor comprises a remote communications link adapted to communicate to a site communicator and report leak conditions.

6. The fueling environment of claim 1 wherein said at least one leak monitor comprises a remote communications link adapted to communicate to a tank monitor and report leak conditions.

7. The fueling environment of claim 1 wherein said at least one leak monitor comprises a remote communications link adapted to communicate to a site controller and report leak conditions.

8. A fueling environment comprising:

an underground storage tank adapted to store fuel for the fueling environment;

a plurality of fuel dispensers;

a piping network of double walled pipe comprising an inner conduit and an outer conduit, said piping network fluidly connecting said plurality of fuel dispensers, wherein fuel is delivered to said plurality of fuel dispensers via said inner conduit and leaks in said inner conduit are captured by said outer conduit and are returned to said underground storage tank; and a plurality of leak detectors, each of said leak detectors associated with a different one of said plurality of fuel dispensers and positioned in said outer conduit;

said piping network connects said plurality of fuel dispensers in a daisy chain arrangement; and wherein a vacuum in said underground storage tank creates a vacuum in said outer conduit so as to cause said leaks to return to the underground storage tank, wherein at least one of the plurality of fuel dispensers comprises:

fuel handling components;

a housing delimiting:

a fuel inlet aperture receiving an incoming portion of the piping network; and a fuel outlet aperture adapted to allow an outgoing portion of the piping network so that fuel is passed to a downstream fuel dispenser within the plurality of fuel dispensers; and a manifold, wherein said piping network includes a t-intersection positioned within said manifold such that fuel is distributed to said fuel handling components, wherein the outer conduit is positioned at least partially within said manifold and extends from said fuel inlet aperture to said fuel outlet aperture without being terminated inside the manifold or at the fuel inlet aperture or at the fuel outlet aperture and substantially prevents fluid passage from said outer conduit to said manifold.

9. The fueling environment of claim 8 wherein said piping network is sloped such that said leaks return to the underground storage tank via gravity.

10. The fueling environment of claim 8 wherein said fuel handling components comprise elements selected from the group consisting of: a fuel pump, a vapor recovery system, a fueling hose, a blender, a flow meter, and a fueling nozzle.

11. The fueling environment of claim 8 wherein at least one of said plurality of leak detectors comprises a remote communications link adapted to communicate to a site communicator and report leak conditions.

12. The fueling environment of claim 8 wherein at least one of said plurality of leak detectors comprises a remote communications link adapted to communicate to a tank monitor and report leak conditions.

13. The fueling environment of claim 8 wherein at least one leak detectors comprises a remote communications link adapted to communicate to a site controller and report leak conditions.

14. A fueling environment, comprising:

a plurality of fuel dispensers; and a double walled piping system adapted to connect fluidly said plurality of fuel dispensers in a daisy chained arrangement such that fuel is delivered to each of the fuel dispensers from an underground storage tank by an inner conduit and leaks within the double walled piping system are returned to the underground storage tank by an outer conduit;

said leaks within the double walled piping system are returned to the underground storage tank with vacuum assistance, wherein at least one of the plurality of fuel dispensers comprises:

fuel handling components;

a housing delimiting:

a fuel inlet aperture receiving an incoming portion of the double walled piping system; and a fuel outlet aperture adapted to allow an outgoing portion of the double walled piping system so that fuel is passed to a downstream fuel dispenser within the plurality of fuel dispensers; and a manifold, wherein said double walled piping system includes a t-intersection positioned within said manifold such that fuel is distributed to said fuel handling components, wherein the outer conduit is positioned at least partially within said manifold and extends from said fuel inlet aperture to said fuel outlet aperture without being terminated inside the manifold or at the fuel inlet aperture or at the fuel outlet aperture and substantially prevents fluid passage from said outer conduit to said manifold.

15. The fueling environment of claim 14 wherein said leaks within the double walled piping system are returned to the underground storage tank via gravity.

16. The fueling environment of claim 14 further comprising:

the underground storage tank, wherein the underground storage tank is adapted to store fuel for the fueling environment.

17. The fueling environment of claim 16 wherein said fuel handling components comprise elements selected from the group consisting of: a fuel pump, a vapor recovery system, a fueling hose, a blender, a flow meter, and a fueling nozzle.

18. A fueling environment comprising:

an underground storage tank adapted to store fuel for the fueling environment;

a plurality of fuel dispensers;

a piping network of double walled pipe comprising an inner conduit and an outer conduit, said piping network fluidly connecting said plurality of fuel dispensers, wherein fuel is delivered to said plurality of fuel dispensers via said inner conduit and leaks in said inner conduit are captured by said outer conduit and are returned to said underground storage tank; and said piping network of double-walled pipe connects said plurality of fuel dispensers in a daisy chain arrangement; and wherein a vacuum in said underground storage tank creates a vacuum in said outer conduit so as to cause said leaks to return to the underground storage tank, wherein at least one of the plurality of fuel dispensers comprises:

fuel handing components;

a housing delimiting a fuel inlet aperture receiving an incoming portion of the piping network; and a fuel outlet aperture adapted to allow an outgoing portion of the piping network so that the fuel is passed to a downstream fuel dispenser within the plurality of fuel dispensers; and a manifold, wherein said piping network includes a t-intersection positioned within said manifold such that fuel is distributed to said fuel handling components, wherein the outer conduit is positioned at least partially within said manifold and extends from said fuel inlet aperture to said fuel outlet aperture without being terminated inside the manifold or at the fuel inlet aperture or at the fuel outlet aperture and substantially prevents fluid passage from said outer conduit to said manifold.

19. The fueling environment of claim 18 wherein said piping network is sloped such that said leaks return to the underground storage tank via gravity.

20. The fueling environment of claim 18 wherein said fuel handling components comprise elements selected from the group consisting of: a fuel pump, a vapor recovery system, a fueling hose, a blender, a flow meter, and a fueling nozzle.

21. A fueling environment comprising:

a plurality of fuel dispensers; and a double walled piping system adapted to connect fluidly said plurality of fuel dispensers such that fuel is delivered to each of the fuel dispensers from an underground storage tank by an inner conduit and leaks within the double walled piping system are returned to the underground storage tank by an outer conduit;

said leaks within the double walled piping system returned to the underground storage tank, wherein at least one of the plurality of fuel dispensers comprises:

fuel handling components;

a housing delimiting:

a fuel inlet aperture receiving an incoming portion of the double walled piping system; and a fuel outlet aperture adapted to allow an outgoing portion of the double walled piping system so that fuel is passed to a downstream fuel dispenser within the plurality of fuel dispensers; and a manifold, wherein said double walled piping system includes a t-intersection positioned within said manifold such that fuel is distributed to said fuel handling components, wherein the outer conduit is positioned at least partially within said manifold and extends from said fuel inlet aperture to said fuel outlet aperture without being terminated inside the manifold or at the fuel inlet aperture or at the fuel outlet aperture and substantially prevents fluid passage from said outer conduit to said manifold.

22. The fueling environment of claim 21 further comprising:

the underground storage tank, wherein the underground storage tank is adapted to store fuel for the fueling environment.

23. The fueling environment of claim 22 wherein said fuel handling components comprise elements selected from the group consisting of: a fuel pump, a vapor recovery system, a fueling hose, a blender, a flow meter, and a fueling nozzle.

24. The fueling environment of claim 21 further comprising a leak detection probe positioned in the outer conduit of the double walled piping system.

25. The fueling environment of claim 24 wherein said leak detection probe comprises a remote communications link adapted to communicate to a site communicator and report leak conditions.

26. The fueling environment of claim 24 wherein said leak detection probe comprises a remote communications link adapted to communicate to a tank monitor and report leak conditions.

27. The fueling environment of claim 24 wherein said leak detection probe comprises a remote communications link adapted to communicate to a site controller and report leak conditions.

28. The fueling environment of claim 21 wherein said double walled piping system comprises a main and branch double walled piping system.

29. The fueling environment of claim 28 wherein the main and branch double walled piping system comprises at least one main conduit and a plurality of branch conduits wherein individual ones of the plurality of branch conduits connect to individual ones of the plurality of fuel dispensers.

30. A fueling environment comprising:

an underground storage tank adapted to store fuel for the fueling environment;

a plurality of fuel dispensers;

a piping network of double walled pipe comprising an inner conduit and an outer conduit, said piping network fluidly connecting said plurality of fuel dispensers, wherein fuel is delivered to said plurality of fuel dispensers via said inner conduit and leaks in said inner conduit are captured by said outer conduit and are returned to said underground storage tank; and wherein at least one of the plurality of fuel dispensers comprises:

fuel handling components;

housing delimiting:

a fuel inlet aperture receiving an incoming portion of the piping network; and a fuel outlet aperture adapted to allow an outgoing portion of the piping network so that fuel is passed to a downstream fuel dispenser within the plurality of fuel dispensers; and a manifold, wherein said piping network includes a t-intersection positioned within said manifold such that fuel is distributed to said fuel handling components, wherein the outer conduit is positioned at least partially within said manifold and extends from said fuel inlet aperture to said fuel outlet aperture without being terminated inside the manifold or at the fuel inlet aperture or at the fuel outlet aperture and substantially prevents fluid passage from said outer conduit to said manifold.

31. The fueling environment of claim 30 wherein said piping network is sloped such that said leaks return to the underground storage tank at least in part via gravity.

32. The fueling environment of claim 30, wherein a vacuum in said underground storage tank creates a vacuum in said outer conduit so as to cause said leaks to return to said underground storage tank.

33. The fueling environment of claim 31 wherein said fuel handling components comprise elements selected from the group consisting of: a fuel pump, a vapor recovery system, a fueling hose, a blender, a flow meter, and a fueling nozzle.

34. The fueling environment of claim 31 further comprising at least one leak detector.

35. The fueling environment of claim 34 wherein said at least one leak detector comprises a remote communications link adapted to communicate to a site communicator and report leak conditions.

36. The fueling environment of claim 34 wherein said at least one leak detector comprises a remote communications link adapted to communicate to a tank monitor and report leak conditions.

37. The fueling environment of claim 34 wherein said at least one leak detector comprises a remote communications link adapted to communicate to a site controller and report leak conditions.

38. The fueling environment of claim 30 wherein said piping network of double walled pipe comprises a main and branch double walled piping system.

39. The fueling environment of claim 38 wherein the main and branch double walled piping system comprises at least one main conduit and a plurality of branch conduits wherein individual ones of the plurality of branch conduits connect to individual ones of the plurality of fuel dispensers.

* * * * *